US007629871B2

(12) United States Patent
Schrum et al.

(10) Patent No.: US 7,629,871 B2
(45) Date of Patent: Dec. 8, 2009

(54) RESILIENT MATERIAL VARIABLE RESISTOR

(75) Inventors: Allan E. Schrum, Wildomar, CA (US); Michael D. Rogers, El Dorado Hills, CA (US)

(73) Assignee: Authentec, Inc., Melbourne, FL (US)

( * ) Notice: Subject to any disclaimer, the term of this patent is extended or adjusted under 35 U.S.C. 154(b) by 0 days.

(21) Appl. No.: 11/701,643

(22) Filed: Feb. 1, 2007

(65) Prior Publication Data

US 2007/0139156 A1 Jun. 21, 2007

Related U.S. Application Data

(60) Division of application No. 10/188,513, filed on Jul. 3, 2002, now Pat. No. 7,190,251, which is a continuation-in-part of application No. 10/060,046, filed on Jan. 28, 2002, now abandoned, which is a division of application No. 09/318,183, filed on May 25, 1999, now Pat. No. 6,404,323.

(51) Int. Cl.
*H01C 10/00* (2006.01)

(52) U.S. Cl. ..... 338/69; 338/47; 338/185; 345/173; 347/62

(58) Field of Classification Search ..... 338/47, 338/69, 185, 158, 95; 345/157, 173, 174; 347/62, 161

See application file for complete search history.

(56) References Cited

U.S. PATENT DOCUMENTS 1,660,161 A 2/1928 Hansen
1,683,059 A 9/1928 Van Deventer (Continued)

FOREIGN PATENT DOCUMENTS

DE 19606408 A1 8/1997

(Continued)

OTHER PUBLICATIONS

Bartholomew J. Kane, "A High Resolution Traction Stress Sensor Array For Use In Robotic Tactile Determination", A Dissertation Submitted to the Department of Mechanical Engineering and the Committee on Graduate Studies of Stanford University in Partial Fulfillment of the Requirements for the Degree of Doctor of Philosophy, Sep. 1999.

(Continued)

*Primary Examiner*—Kyung Lee
(74) *Attorney, Agent, or Firm*—Allen, Dyer, Doppelt, Milbrath & Gilchrist, P.A. Attorneys at Law

(57) ABSTRACT

A variable resistance device comprises a resistive member having a resistive resilient material. A first conductor is configured to be electrically coupled with the resistive member at a first contact location over a first contact area. A second conductor is configured to be electrically coupled with the resistance member at a second contact location over a second contact area. The first contact location and second contact location are spaced from one another by a distance. The resistance between the first conductor at the first contact location and the second conductor at the second contact location is equal to the sum of a straight resistance component and a parallel path resistance component. At least one of the first location, the second location, the first contact area, and the second contact area is changed to produce a change in resistance between the first conductor and the second conductor. The straight resistance component increases or decreases as the distance between the first contact location and the second contact location increases or decrease, respectively. The parallel path resistance component has preset desired characteristics based on selected first and second contact locations and selected first and second contact areas. The first and second contact locations and first and second contact areas can be selected such that the change in the resistance between the first and second contact locations is at least substantially equal to the change in the straight resistance component or the change in the parallel path resistance component.

16 Claims, 10 Drawing Sheets

U.S. PATENT DOCUMENTS

| | | | | |
|---|---|---|---|---|
| 3,393,390 | A | 7/1968 | Louis | |
| 3,610,887 | A | 10/1971 | Betzer | 219/501 |
| 3,621,439 | A | 11/1971 | Newbery | 338/180 |
| 3,624,584 | A | 11/1971 | Ohno | 338/69 |
| 3,863,195 | A | 1/1975 | Bowen | 338/183 |
| 3,960,044 | A | 6/1976 | Nagai et al. | 84/1.01 |
| 3,997,863 | A | 12/1976 | Luce | 338/69 |
| 4,079,651 | A * | 3/1978 | Matsui | 84/690 |
| 4,152,304 | A | 5/1979 | Tadewald | 252/506 |
| 4,257,305 | A | 3/1981 | Friend et al. | 84/1.24 |
| 4,273,682 | A | 6/1981 | Kanomori | 252/511 |
| 4,333,068 | A | 6/1982 | Kishel | 338/158 |
| 4,419,653 | A | 12/1983 | Waigand | 338/114 |
| 4,438,158 | A | 3/1984 | Eichelberger et al. | 427/101 |
| 4,479,392 | A | 10/1984 | Froeb et al. | 73/862.68 |
| 4,604,509 | A | 8/1986 | Clancy et al. | 200/159 B |
| 4,745,301 | A | 5/1988 | Michalchik | 307/119 |
| 4,746,894 | A | 5/1988 | Zeldman | 338/99 |
| 4,765,930 | A | 8/1988 | Mashimo et al. | 252/511 |
| 4,775,765 | A | 10/1988 | Kimura et al. | 178/18 |
| 4,833,440 | A | 5/1989 | Wojtanek | 338/114 |
| 4,878,040 | A | 10/1989 | Tamura | 338/158 |
| 4,894,493 | A | 1/1990 | Smith et al. | 200/5 |
| 4,933,660 | A | 6/1990 | Wynne, Jr. | 338/114 |
| 4,952,761 | A | 8/1990 | Viebrantz | 200/513 |
| 5,060,527 | A | 10/1991 | Burgess | 73/862.68 |
| 5,068,638 | A | 11/1991 | Bickely et al. | 338/114 |
| 5,162,775 | A | 11/1992 | Kuramochi et al. | 338/114 |
| 5,164,697 | A | 11/1992 | Kramer | 338/69 |
| 5,296,835 | A | 3/1994 | Nakamura | 338/130 |
| 5,376,913 | A | 12/1994 | Pine et al. | 338/114 |
| 5,429,006 | A | 7/1995 | Tamori | 73/862.046 |
| 5,499,041 | A | 3/1996 | Brandenburg et al. | 345/174 |
| 5,614,881 | A | 3/1997 | Duggal et al. | 338/22 R |
| 5,621,318 | A | 4/1997 | Jacobsen et al. | 324/207.22 |
| 5,644,283 | A | 7/1997 | Grosse-Wilde et al. | 338/20 |
| 5,675,309 | A | 10/1997 | DeVolpi | 338/68 |
| 5,689,285 | A | 11/1997 | Asher | 345/161 |
| 5,876,106 | A | 3/1999 | Kordecki | 362/29 |
| 5,889,507 | A | 3/1999 | Engle et al. | 345/161 |
| 5,912,612 | A | 6/1999 | DeVolpi | 338/95 |
| 5,943,052 | A | 8/1999 | Allen et al. | 345/341 |
| 5,945,929 | A | 8/1999 | Westra | 341/34 |
| 5,949,325 | A | 9/1999 | Devolpi | 338/154 |
| 5,999,084 | A | 12/1999 | Armstrong | 338/114 |
| 6,067,005 | A * | 5/2000 | DeVolpi | 338/47 |
| 6,087,925 | A | 7/2000 | DeVolpi | 338/92 |
| 6,208,271 | B1 | 3/2001 | Armstrong | 341/34 |
| 6,236,034 | B1 | 5/2001 | DeVolpi | 250/221 |
| 6,239,790 | B1 | 5/2001 | Martinelli et al. | 345/174 |
| 6,256,012 | B1 | 7/2001 | Devolpi | 345/161 |
| 6,313,731 | B1 | 11/2001 | Vance | 338/185 |
| 6,323,846 | B1 | 11/2001 | Westerman et al. | 345/173 |
| 6,344,791 | B1 | 2/2002 | Armstrong | 338/114 |
| 6,400,303 | B2 | 6/2002 | Armstrong | 341/176 |
| 6,404,323 | B1 | 6/2002 | Schrum et al. | 338/92 |
| 6,437,682 | B1 | 8/2002 | Vance | 338/185 |
| 6,754,365 | B1 | 6/2004 | Wen et al. | 382/100 |
| 7,003,670 | B2 | 2/2006 | Heaven et al. | 713/186 |
| 7,391,296 | B2 | 6/2008 | Schrum et al. | 338/99 |
| 2001/0012036 | A1 | 8/2001 | Giere et al. | 347/62 |
| 2002/0130673 | A1 | 9/2002 | Pelrine et al. | 324/727 |
| 2003/0002718 | A1 | 1/2003 | Hamid | 382/124 |
| 2003/0028811 | A1 | 2/2003 | Russo et al. | 345/157 |
| 2003/0214481 | A1 | 11/2003 | Xiong | 345/157 |
| 2005/0012714 | A1 | 1/2005 | Russo et al. | 345/157 |
| 2005/0041885 | A1 | 2/2005 | Russo | 382/289 |
| 2005/0179657 | A1 | 8/2005 | Russo et al. | 345/163 |
| 2006/0103633 | A1 | 5/2006 | Gioeli | 345/173 |
| 2007/0061126 | A1 | 3/2007 | Ursso et al. | 703/24 |

FOREIGN PATENT DOCUMENTS

| | | | |
|---|---|---|---|
| JP | 09071135 | A | 3/2007 |
| WO | WO 01/39134 | A3 | 5/2001 |
| WO | WO 01/73678 | A1 | 10/2001 |
| WO | WO 01/94892 | A3 | 12/2001 |
| WO | WO 01/94966 | A2 | 12/2001 |
| WO | WO 01/95305 | A1 | 12/2001 |
| WO | WO 02/086800 | A1 | 10/2002 |
| WO | WO 03/075210 | A2 | 9/2003 |

OTHER PUBLICATIONS

U.S. Patent and Trademark Office Action for U.S. Appl. No. 11/494,828, mailed on Dec. 18, 2006.

Applicant response to Dec. 18, 2006 U.S. Patent and Trademark Office Action for U.S. Appl. No. 11/701,579, mailed on Mar. 12, 2007.

U.S. Patent and Trademark Office Action for U.S. Appl. No. 11/494,828, mailed on Jun. 14, 2007.

Applicant response to Jun. 14, 2007 U.S. Patent and Trademark Office Action for U.S. Appl. No. 11/701,579, mailed on Sep. 7, 2007.

U.S. Patent and Trademark Office Action for U.S. Appl. No. 11/546,652, mailed on Feb. 25, 2008.

Applicant response to Oct. 11, 2006 U.S. Patent and Trademark Office Action for U.S. Appl. No. 11/701,579, mailed on Mar. 14, 2008.

U.S. Patent and Trademark Office Action for U.S. Appl. No. 11/701,579, mailed on Jan. 14, 2008.

Applicant response to the Jan. 14, 2008 U.S. Patent and Trademark Office Action for U.S. Appl. No. 11/701,579, mailed on Feb. 20, 2008.

U.S. Patent and Trademark Office Action for U.S. Appl. No. 11/701,890, mailed on Sep. 26, 2007.

Applicant response to Sep. 26, 2007 U.S. Patent and Trademark Office Action for U.S. Appl. No. 11/701,579, mailed on Oct. 31, 2007.

U.S. Patent and Trademark Office Action for U.S. Appl. No. 11/701,618, mailed on Dec. 28, 2007.

Applicant response to Dec. 28, 2007 U.S. Patent and Trademark Office Action for U.S. Appl. No. 11/701,579, mailed on Mar. 25, 2008.

U.S. Patent and Trademark Office; Office Action for U.S. Appl. No. 11/701,578, mailed May 16, 2008.

Applicant response to May 16, 2008. U.S. Patent and Trademark Office Action for U.S. Appl. No. 11/701,579, mailed on Mar. 12, 2007.

* cited by examiner

RESILIENT MATERIAL VARIABLE RESISTOR

This Application is a Divisional Application of the application Ser. No. 10/188,513, titled "VARIABLE RESISTANCE DEVICES AND METHODS", filed Jul. 3, 2002 now U.S. Pat. No. 7,190,251 which is a continuation-in-part of U.S. patent application No. 10/060,046, filed Jan. 28, 2002, now abandoned which is a divisional application of U.S. patent application Ser. No. 09/318,183, filed May 25, 1999 now U.S. Pat. No. 6,404,323 the disclosures of which are incorporated herein by reference. Other divisional applications from Application Ser. No. 10/188,513 are 11/494,828 titled "RESILIENT MATERIAL POTENTIOMETER", filed Jul. 28, 2006; 11/544,114 titled "LINEAR RESILIENT MATERIAL VARIABLE RESISTOR", filed Oct. 6, 2006; and 11/546,652 titled "RESILIENT MATERIAL VARIABLE RESISTOR", filed Oct. 11, 2006.

BACKGROUND OF THE INVENTION

This invention relates generally to variable resistance devices and methods and, more particularly, to devices and methods which employ resistive resilient materials including resistive rubber materials for providing variable resistance.

Variable resistance devices have been used in many applications including sensors, switches, and transducers. A potentiometer is a simple example of a variable resistance device which has a fixed linear resistance element extending between two end terminals and a slider which is keyed to an input terminal and makes movable contact over the resistance element. The resistance or voltage (assuming constant voltage across the two end terminals) measured across the input terminal and a first one of the two end terminals is proportional to the distance between the first end terminal and the contact point on the resistance element.

Resistive elastomers or resistive rubber materials have been used as resistance elements including variable resistance devices. The terms "resistive rubber" and "resistive rubber material", as used herein, refer to an elastomeric or rubber material which is interspersed with electrically conductive materials including, for example, carbon black or metallic powder. Heretofore, the use of resistive rubber in variable resistance devices has been limited to relatively simple and specific applications. For instance, some have only exploited the variable resistance characteristics of a resistive rubber caused by deformation such as stretching and compression. There is a need for variable resistance devices and methods which utilize more fully the resistive characteristics of resistive rubber materials.

SUMMARY OF THE INVENTION

The present invention relates to variable resistance devices and methods that make use of the various resistive characteristics of resistive rubber materials. The inventors have discovered characteristics of resistive resilient materials such as resistive rubber materials that previously have not been known or utilized.

Specific examples of resistive resilient materials include, without limitation, the following materials interspersed with electrically conductive materials: silicone (e.g., HB/VO rated), natural rubber (NR), styrene butadiene rubber (SBR), ethylene propylene rubber (EPDM), nitrile butadiene rubber (NBR), butyl rubber (IR), butadiene rubber (BR), chloro sulfonic polyethylene (Hypalon®), Santoprene® (TPR), neoprene, chloroprene, Viton®, elastomers, and urethane.

The resistance of a resistor is directly proportional to the resistivity of the material and the length of the resistor and inversely proportional to the cross-sectional area perpendicular to the direction of current flow. The resistance is represented by the following well-known equation:

$$R=\rho l/A \tag{1}$$

where ρ is the resistivity of the resistor material, l is the length of the resistor along the direction of current flow, and A is the cross-sectional area perpendicular to the current flow. Resistivity is an inherent property of a material and is typically in units of Ω·cm. The voltage drop across the resistor is represented by the well-known Ohm's law:

$$R=E/I \tag{2}$$

where E is the voltage across the resistor and I is the current through the resistor.

When resistors are joined together in a network, the effective resistance is the sum of the individual resistances if the resistors are joined in series. The effective resistance increases when the number of resistors that are joined in series increases. That is, the effective resistance increases when the total length l of the resistors increases, assuming a constant cross-sectional area A according to a specific example based on equation (1). If the resistors are joined in parallel, however, the effective resistance is the reciprocal of the sum of the reciprocals of the individual resistances. The higher the number of resistors that are joined in parallel, the lower the effective resistance is. This is also consistent with equation (1), where the effective resistance decreases when the total area A of the resistors increases in a specific example, assuming a constant length l.

Commonly available resistors typically include conductive terminals at two ends or leads that are connected between two points in a circuit to provide resistance. These resistors are simple and discrete in structure in the sense that they each have well-defined contact points at two ends with a fixed resistance therebetween. The effective resistance of a resistive network formed with resistors that have such simple, discrete structures is easily determinable by summing the resistances for resistors in series and by summing the reciprocals of the resistances for resistors that are in parallel and taking the reciprocal of the sum. Geometric factors and contact variances are absent or at least sufficiently insignificant in these simple resistors so that the effective resistance is governed by the simple equations described above. When the resistors are not simple and discrete in structure, however, the determination of the effective resistance is no longer so straightforward.

The inventors have discovered that the effective resistance is generally the combination of a straight path resistance component and a parallel path resistance component. The straight path resistance component or straight resistance component is analogous to resistors in series in that the straight resistance component between two contact locations increases with an increase in distance between the two contact locations, just as the effective resistance increases when the total length l increases and the area A is kept constant in equation (1). The increase in the amount of resistive material in the current path between the two contact locations causes the increase in resistance. The parallel path resistance component is analogous to resistors in parallel. As discussed above, the effective resistance decreases when the total area A of the combined resistors having a common length l increases. This results because there are additional current paths or "parallel paths" provided by the additional resistors joined in parallel. Similarly, when the amount of parallel paths increases between two contact locations due to changes in geometry or contact variances, the parallel path resistance component decreases. As used herein, the term "parallel paths" denote multiple paths available for electrical current flow between contact locations, and are not limited to paths that are geometrically parallel.

In accordance with an aspect of the present invention, a variable resistance device comprises a resistive member comprising a resistive resilient material. A first conductor is configured to be electrically coupled with the resistive member at a first contact location over a first contact area. A second conductor is configured to be electrically coupled with the resistive member at a second contact location over a second contact area. The first contact location and the second contact location are spaced from one another by a distance. A resistance between the first conductor at the first contact location and the second conductor at the second contact location is equal to the sum of a straight resistance component and a parallel path resistance component. The straight resistance component increases as the distance between the first contact location and the second contact location increases, and decreases as the distance between the first contact location and the second contact location decreases. The parallel path resistance component has preset desired characteristics based on selected first and second contact locations and selected first and second contact areas.

In certain embodiments, the first and second locations and first and second contact areas are selected to provide a parallel path resistance component which is at least substantially constant with respect to changes in the distance between the first contact location and the second contact location. As a result, the resistance between the first conductor at the first contact location and the second conductor at the second contact location increases as the distance between the first contact location and the second contact location increases, and decreases as the distance between the first contact location and the second contact location decreases.

In other embodiments, the first and second contact locations and first and second contact areas are selected such that the parallel path resistance component is substantially larger than the straight resistance component. The change in the resistance between the first conductor at the first contact location and the second conductor at the second contact location is at least substantially equal to the change in the parallel path resistance component between the first conductor and the second conductor.

In still other embodiments, the resistive member has a resistive surface for contacting the first and second conductors at the first and second contact locations, respectively. The resistive surface has an outer boundary and a thickness which is substantially smaller than a square root of a surface area of the resistive surface. The parallel path resistance component between the first conductor at the first contact location and the second conductor at the second contact location is substantially larger than the straight resistance component when both the first and second contact locations are disposed away from the outer boundary of the resistive surface. The straight resistance component between the first conductor at the first contact location and the second conductor at the second contact location is substantially larger than the parallel path resistance component when at least one of the first and second contact locations is at or near the outer boundary of the resistive surface.

In accordance with other aspects of the invention, the resistance between the first conductor at the first contact location and the second conductor at the second contact location increases when the resistive member undergoes a stretching deformation between the first contact location and the second contact location. The resistance between the first conductor at the first contact location and the second conductor at the second contact location decreases when the resistive member is subject to a pressure between the first contact location and the second contact location. The resistance between the first conductor at the first contact location and the second conductor at the second contact location increases when the resistive member undergoes a rise in temperature between the first contact location and the second contact location, and decreases when the resistive member undergoes a drop in temperature between the first contact location and the second contact location.

Another aspect of the present invention is directed to a method of providing a variable resistance from a resistive member including a resistive resilient material. The method comprises electrically coupling a first conductor with the resistive member at a first location over a first contact area and electrically coupling a second conductor with the resistive member at a second location over a second contact area. At least one of the first location, the second location, the first contact area, and the second contact area is changed to produce a change in resistance between the first conductor and the second conductor. The resistance between the first conductor and the second conductor includes a straight resistance component and a parallel path resistance component. The straight resistance component increases as the distance between the first location and the second location increases and decreases as the distance between the first location and the second location decreases. The parallel path resistance component has preset desired characteristics based on selected first and second locations and selected first and second contact areas.

Another aspect of the invention is directed to a method of providing a variable resistance from a resistive member including a resistive resilient material. The method comprises electrically coupling a first conductor with the resistive member at a first contact location over a first contact area, and electrically coupling a second conductor with the resistive member at a second contact location over a second contact area. The second contact location is spaced from the first contact location by a variable distance. At least one of the first location, the second location, the first contact area, and the second contact area is changed to produce a change in resistance in the resistive member, measured between the first conductor at the first contact location and the second conductor at the second contact location, as the resistive member deforms along the second conductor.

DESCRIPTION OF THE SPECIFIC EMBODIMENTS

Figure 1A:
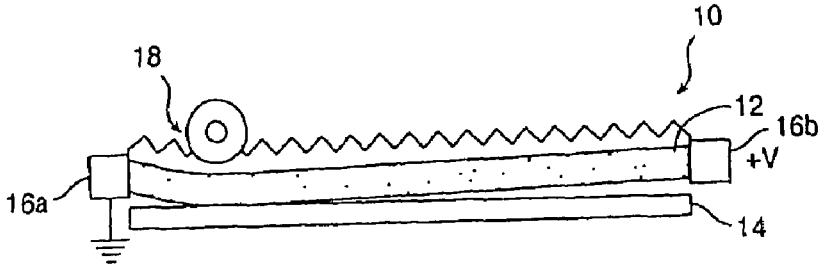
FIGS. 1*a*-1*c* are elevational views of a variable resistance device exhibiting effective straight resistance characteristics in accordance with an embodiment of the present invention.

The variable resistance devices of the present invention include components made of resistive resilient materials. An example is a low durometer rubber having a carbon or a carbon-like material imbedded therein. The resistive resilient material advantageously has a substantially uniform or homogeneous resistivity, which is typically formed using very fine resistive particles that are mixed in the rubber for a long period of time in the forming process. The resistive property of resistive resilient material is typically measured in terms of resistance per a square block or sheet of the material. The resistance of a square block or sheet of a resistive resilient material measured across opposite edges of the square is constant without regard to the size of the square. This property arises from the counteracting nature of the resistance-in-series component and resistance-in-parallel component which make up the effective resistance of the square of material. For instance, when two square blocks of resistive resilient material each having a resistance of 1Ω across opposite edges are joined in series, the effective resistance becomes 2Ω due to the doubling of the length. By coupling two additional square blocks along the side of the first two square blocks to form a large square, the effective resistance is the reciprocal of the sum of the reciprocals. The sum of the reciprocals is $\frac{1}{2}\Omega^{-1}+\frac{1}{2}\Omega^{-1}=1\Omega^{-1}$. Thus the effective resistance for a large square that is made up of 4 small squares is 1Ω, which is the same as the resistance of each small square. The use of the resistance-in-series or straight path resistance component and the resistance-in-parallel or parallel path resistance component of the resistive resilient material is discussed in more detail below.

The resistance per square of the resistive resilient material employed typically falls within the range of about 10-100Ω per square. In some applications, the variable resistance device has a moderate resistance below about 50,000 ohms (Ω). In certain applications involving joysticks or other pointing devices, the range of resistance is typically between about 1,000 and 25,000 ohms. Advantageously, the resistive resilient material can be formed into any desirable shape, and a wide range of resistivity for the material can be obtained by varying the amount of resistive particles embedded in the resilient material.

The resistive response of a variable resistance device made of a resistive resilient material can be attributed to three categories of characteristics: material characteristics, electrical characteristics, and mechanical characteristics.

A. Material Characteristics

The resistance of a resistive resilient material increases when it is subjected to stretching and decreases when it is subjected to compression or pressure. The deformability of the resistive resilient material renders it more versatile than materials that are not as deformable as the resistive resilient material. The resistance of a resistive resilient material increases with an increases in temperature and decreases with a decrease in temperature.

B. Electrical Characteristics

The effective resistance of a resistive resilient component is generally the combination of a straight path resistance component and a parallel path resistance component. The straight path resistance component or straight resistance component is analogous to resistors in series in that the straight resistance component between two contact locations increases with an increase in distance between the two contact locations, just as the effective resistance increases when the number of discrete resistors joined in series increases. The parallel path resistance component is analogous to resistors in parallel in that the parallel path resistance component decreases when the amount of parallel paths increases between two contact locations due to changes in geometry or contact variances, just as the effective resistance decreases when the number of discrete resistors joined in parallel increases, representing an increase in the amount of parallel paths.

To demonstrate the straight resistance characteristics and parallel path resistance characteristics, specific examples of variable resistance devices are described herein. In some examples, straight resistance is the primary mode of operation. In other examples, parallel path resistance characteristics are dominant.

1. Straight Path Resistance

One way to provide a variable resistance device that operates primarily in the straight resistance mode is to maintain the parallel path resistance component at a level which is at least substantially constant with respect to changes in the distance between the contact locations. The parallel path resistance component varies with changes in geometry and contact variances. The parallel path resistance component may be kept substantially constant if, for example, the geometry of the variable resistance device, the contact locations, and the contact areas are selected such that the amount of parallel paths between the contact locations remains substantially unchanged when the contact locations are moved.

Figure 1B:
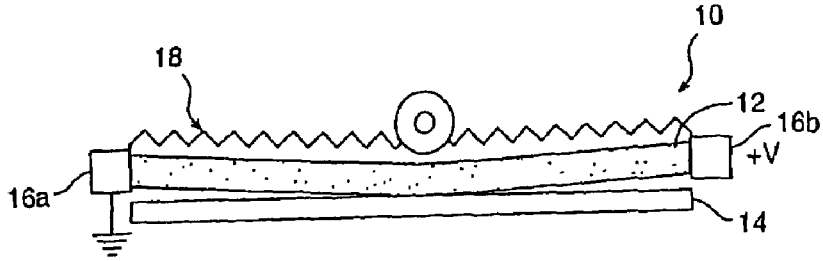
Figure 1C:
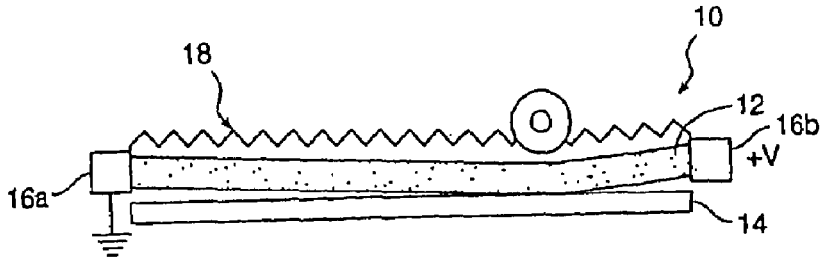
Figure 1D:
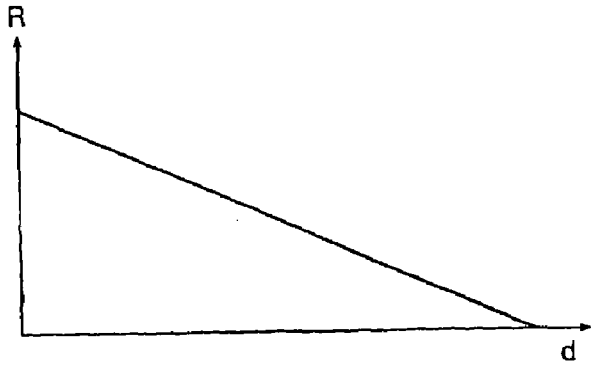
FIG. 1*d* is a plot of the effective resistance as a function of the contact location for the variable resistance device of FIGS. 1*a*-1*c;*

An example is a potentiometer 10 shown in FIGS. 1*a*-1*c*. A resistive resilient transducer 12 is disposed adjacent and generally parallel to a conductor or conductive substrate 14. The resistive resilient transducer 12 is supported at two ends by end supports 16*a*, 16*b*, and is normally spaced from the conductor 14 by a small distance. A roller or wheel mechanism 18 is provided for applying a force on the transducer 12 to deflect the transducer 12 to make contact with the conductor 14 at different locations between the two ends of the transducer 12, as illustrated in FIGS. 1*a*-1*c*. In this embodiment, one end of the resistive resilient transducer 12 adjacent the first end support 16*a* is grounded and the other end adjacent the second end support 16*b* is energized with an applied voltage V. As the roller mechanism 18 deflects the transducer 12 to contact the conductor 14 at different locations, voltage measurements taken along the length of the transducer 12 increases as the contact location approaches the end with the applied voltage V. Also, resistance readings R taken at the contact locations d vary between the two ends of the transducer 12. This is illustrated in the plot in FIG. 1*d*.

Figure 2:
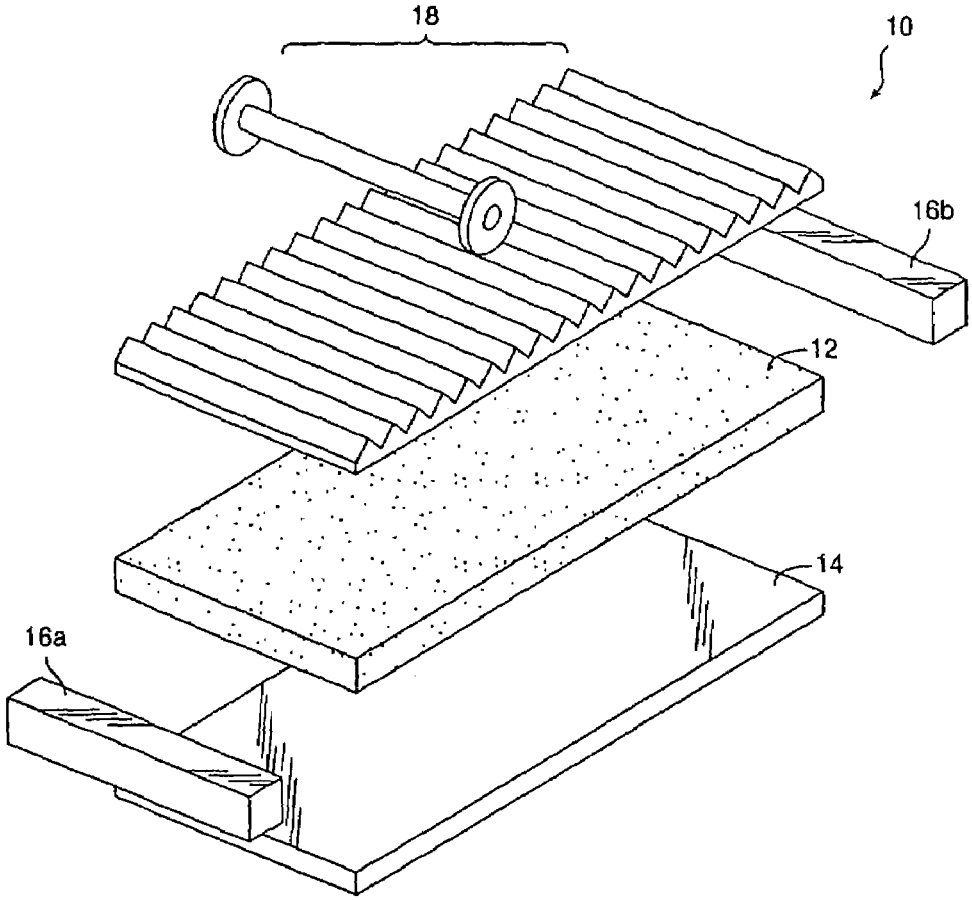
FIG. 2 is a perspective view of the variable resistance device of FIGS. 1-2.

FIG. 2 shows that the transducer 12 and conductor 14 have generally constant widths and the roller mechanism 18 is set up so that the contact area between the transducer 12 and the conductor 14 remains generally constant at different contact locations. The contact area preferably extends across the entire width of the transducer 12 which amounts to a substantial portion (almost half) of the perimeter of the cross-section of the transducer 12 at the contact location. The resistive resilient transducer 12 has a substantially uniform cross-section, and the resistive resilient material preferably has substantially uniform resistive properties. The voltage V is applied at the end of the transducer 12 substantially across the entire cross-section. This may be done by capping the entire end with a conductive cap or conductive end support 16*b* and applying the voltage through the conductive end support 16*b*. The other end of the transducer 12 is grounded preferably also across the entire cross-section, for instance, by capping the end with a grounded conductive end support 16*a*. This end may alternatively be energized with another voltage which is different from the voltage V to create the voltage differential between the two ends of the transducer. In a specific embodiment, the resistive resilient transducer 12 has a thickness which is significantly smaller than its width and length (e.g., the width is at least about 5 times the thickness), so that the transducer 12 is a thin strip, which is flat and straight in the embodiment shown.

Figure 3:
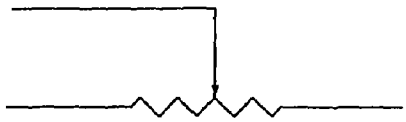
FIG. 3 is a schematic view of the variable resistance device of FIGS. 1*a*-1 *c;*

Current flows from the applied voltage end of the transducer 12 to the grounded end of the transducer 12 via parallel paths that extend along the length of the transducer 12. For the variable resistance device 10, the contact area between the resistive resilient transducer 12 and the conductor 14 is substantially constant and the amount of parallel paths remains substantially unchanged as the contact location is moved across the length of the transducer. As a result, the parallel path resistance component is kept substantially constant, so that the change in the effective resistance of the device 10 due to a change in contact location is substantially equal to the change in the straight resistance component. The straight resistance component typically varies in a substantially linear fashion with respect to the displacement of the contact location because of the uniform geometry and homogeneous resistive properties of the resistive resilient material (see FIG. 1*d*). FIG. 3 shows a schematic representation of the potentiometer 10 of FIGS. 1-2.

Figure 4:
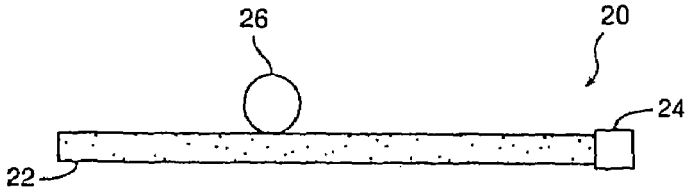
FIG. 4 is an elevational view of a variable resistance device exhibiting effective straight resistance characteristics in accordance with another embodiment of the invention.

Another variable resistance device 20 which also operates primarily on straight resistance principles is shown in FIG. 4. The device 20 includes a generally longitudinal resistive resilient member 22 which is substantially uniform in cross-section. For instance, the member 22 may be generally identical to the resistive resilient transducer 12 in FIG. 2. One end of the resistive resilient member 22 is coupled to a first conductor 24, preferably across substantially the entire cross-section. A second conductor 26 makes movable contact with the resistive resilient member 22 along its length to define a variable distance with respect to the first conductor 24. In this embodiment, the movable conductor 26 includes a roller with a curved surface which makes rolling contact on the surface of the resistive resilient member 22. The contact area between the movable conductor 26 and the resistive resilient member is substantially constant, and preferably extends across the entire width of the member 22 which amounts to a substantial portion (almost half) of the perimeter of the cross-section of the member 22 at the contact location. In this way, the amount of parallel paths between the first conductor 24 and the second conductor 26 is substantially unchanged during movement of the second conductor 26 relative to the first conductor 24. The effective resistance of the variable resistance device 20 exhibits straight resistance characteristics, and increases or decreases when the variable distance between the first conductor 24 and the second conductor 26 increases or decreases, respectively. If the resistive properties of the resistive resilient material are substantially uniform, the effective resistance varies substantially linearly with respect to changes in the distance between the first conductor 24 and the second conductor 26 in a manner similar to that shown in FIG. 1*d*.

Figure 5A:
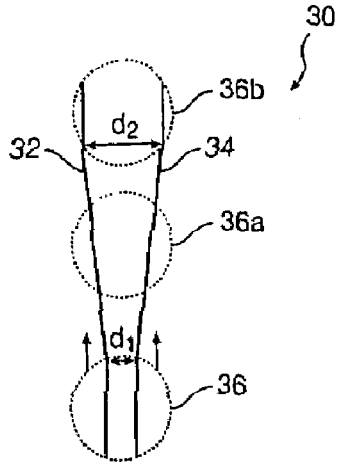
FIG. 5*a* is a plan view of a variable resistance device exhibiting effective straight resistance characteristics in accordance with another embodiment of the invention.
Figure 5B:
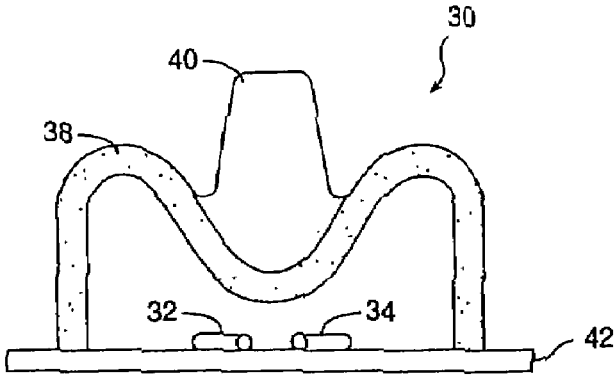
FIG. 5*b* is an elevational view of the variable resistance device of FIG. 5*a;*

Another example of a variable resistance device 30 as shown in FIGS. 5*a* and 5*b* employs two conductors 32, 34 in tandem. The conductor surfaces of the two conductors 32, 34 which are provided for making contact with a resistive surface or footprint 36 are spaced from each other by a variable distance. In the embodiment shown, the conductors 32, 34 are longitudinal members with substantially constant widths, and the distance between them increases from one end of each conductor 32, 34 to the other end. The resistive footprint 36 movably contacts the first conductor surface of the first conductor 32 over a first contact area and the second conductor surface of the second conductor 34 over a second contact area. FIG. 5*a* shows movement of the footprint 36 to positions 36*a*, 36*b*. The first contact area and second contact area respectively remain substantially constant during movement of the footprint 36 to positions 36*a*, 36*b*. In the embodiment shown, the resistive footprint 36 is substantially constant in area and circular in shape. FIG. 5*b* shows an embodiment of a resistive resilient member 38 which provides the circular resistive footprint 36. The resistive resilient member 38 includes a curved resistive surface which is manipulated by a stick or joystick 40 to make rolling contact with the conductors 32, 34. In the embodiment shown, the conductor 32, 34 are disposed on a substrate 42, and the resistive resilient member 38 is resiliently supported on the substrate 42. When a force is applied on the joystick 40 to push the resistive resilient member 38 down toward the substrate 42, it forms a resistive footprint 36 in contact with the conductors 32, 34. When the force shifts in the direction of the conductors 32, 34, the footprint 36 moves to locations 36*a*, 36*b*. When the force is removed, the resilient resistive resilient member 38 is configured to return to the rest position shown in FIG. 5*b* above the conductors 32, 34. The resistive resilient member 38 preferably has a thickness which is substantially less than a square root of the area of the resistive footprint. For example, the thickness may be less than about ⅕of the square root of the area of the resistive footprint.

The resistive footprint 36 bridges across the two conductor surfaces defined by an average distance over the footprint 36. The use of an average distance is necessary because the distance is typically variable within a footprint. Given the geometry of the variable resistance device 30 and the contact locations and generally constant contact areas between the conductors 32, 34 and the footprint 36 of the resistive resilient member 38, the amount of parallel paths between the two conductors 32, 34 is substantially unchanged. As a result, the change in the effective resistance is substantially governed by the change in the straight resistance component of the device 30, which increases or decreases with an increase or decrease, respectively, of the average distance between the portions of the conductor surfaces of the two conductors 32, 34 which are in contact with the resistive footprint 36. If the average distance varies substantially linearly with displacement of the resistive footprint 36 relative to the conductors 32, 34 (e.g., from $d_1$ to $d_2$ as shown for a portion of the conductors 32, 34 in FIG. 5*a*), and the resistive properties of the resistive resilient material are substantially constant, then the effective resistance also varies substantially linearly with displacement of the footprint 36. Alternatively, a particular nonlinear resistance curve can result by arranging the conductors 32, 34 to define a specific variation in the average distance between them (e.g., logarithmic variations).

2. Parallel Path Resistance

The effective resistance of a device exhibits parallel path resistance behavior if the straight resistance component is kept substantially constant. FIGS. 6 and 7 show examples of variable resistance devices that operate primarily in the parallel path resistance mode.

Figure 6A:
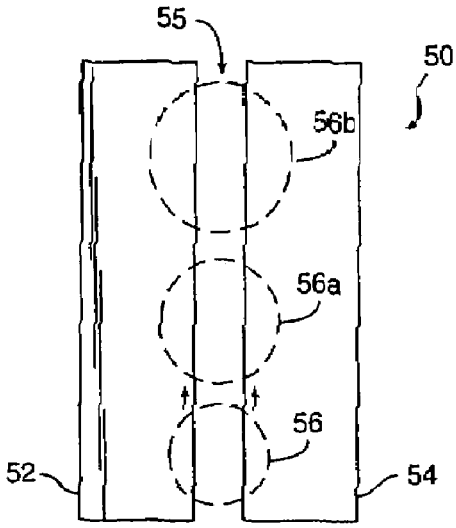
FIG. 6*a* is a schematic view of a variable resistance device exhibiting effective parallel path resistance characteristics in accordance with an embodiment of the invention.
Figure 7:
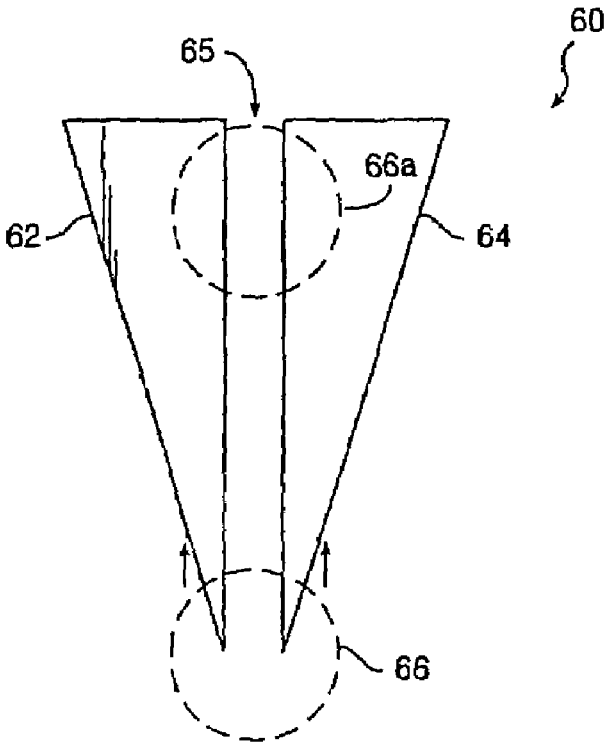
FIG. 7 is a schematic view of a variable resistance device exhibiting effective parallel path resistance characteristics in accordance with another embodiment of the invention.

In FIG. 6*a*, the variable resistance device 50 includes a pair of conductors 52, 54 which are spaced from each other by a gap 55 which is substantially constant in size. The conductor surfaces of the conductors 52, 54 in the embodiment shown are generally planar and rectangular with straight edges defining the gap 55. The edges which define the gap may have nonlinear shapes in other embodiments. A resistive footprint 56 bridges across the gap between the conductors 52, 54 and changes in size to footprints 56*a*, 56*b*. In the embodiment shown, the resistive footprint 56 is circular and makes movable contact with the conductors 52, 54 in a generally symmetrical manner as it increases in size to footprints 56*a*, 56*b*. Alternate footprint shapes and nonsymmetrical contacts may be employed in other embodiments. The movable contact may be produced by a resistive resilient member similar to the resistance member 38 shown in FIG. 5 with the joystick 40 for manipulating the movement of the footprint 56. The change in the area of the footprint 56 may be generated by increasing the deformation of the resistive resilient member 38. For instance, a larger force pushing downward on the joystick 40 against the resistive resilient member 38 produces greater deformation of the resistive resilient member 38 and thus a larger footprint size.

Because the gap 55 between the conductors 52, 54 which is bridged by the resistive footprint 56 is substantially constant, the straight resistance component of the overall resistance is substantially constant. The effective resistance of the variable resistance device 50 is thus dictated by the parallel path resistance component. The amount of parallel paths increases with an increase in the contact areas between the resistive footprint from 56 to 56*a*, 56*b* and the conductors 52, 54. The parallel path resistance component decreases with an increase in parallel paths produced by the increase in the contact areas. Thus, the effective resistance of the device 50 decreases with an increase in the contact area from the footprint 56 to footprints 56*a*, 56*b*. In the embodiment shown, the contact areas between the resistive footprint 56 and the conductors 52, 54 increase continuously in the direction of movable contact from the footprint 56 to footprints 56*a*, 56*b*. In such a configuration, the parallel path resistance component between the conductors 52, 54 decreases in the direction of the movable contact. The change in the contact areas can be selected to provide a particular resistance response for the variable resistance device 50 such as, for example, a resistance that decreases in a linear manner with respect to the displacement of the footprint 56 in the direction to footprints 56*a*, 56*b*.

Figure 6B:
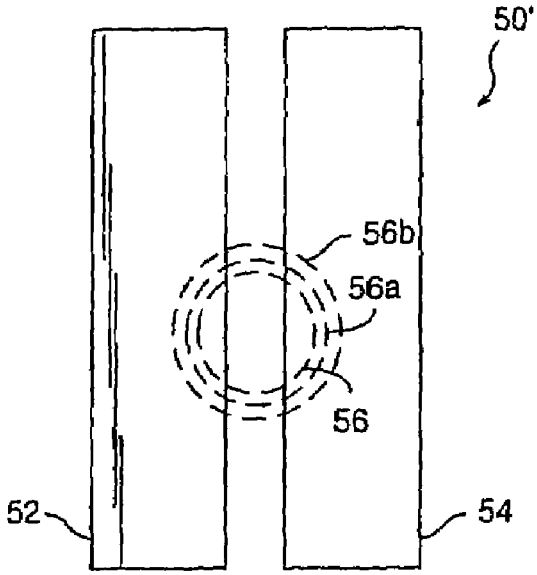
FIG. 6*b* is a schematic view of a variable resistance device exhibiting effective parallel path resistance characteristics in accordance with another embodiment of the invention.

Although FIG. 6*a* shows a moving resistive footprint 56, a similar variable resistance device 50' will exhibit similar characteristics for a stationary footprint 56 that changes in size to footprints 56*a*, 56*b* as illustrated in FIG. 6*b*. Further, FIG. 6*a* shows a footprint 56 that maintains its circular shape, but a footprint 56 in an alternative embodiment may change shape (e.g., from circular to elliptical) in addition to size.

In FIG. 7, the variable resistance device 60 includes a pair of conductors 62, 64 having nonuniformly shaped conductor surfaces for making contact with a resistive footprint 66. The conductor surfaces are spaced by a substantially constant gap 65 in a manner similar to that shown in FIG. 6*a*. The resistive footprint 66 is circular and makes movable contact with the conductor surfaces which are triangular in this embodiment. The resistive footprint 66 maintains a substantially constant size when it moves over the conductor surfaces to footprint 66*a*. This device 60 is similar to the device 50 in FIG. 6*a* except for the triangular conductor surfaces and the substantially constant footprint size. As in the device 50 in FIG. 6*a*, the constant gap 65 in this device 60 produces a straight resistance component that is substantially constant. When the resistive footprint 66 moves relative to the conductors 62, 64 to footprint 66*a*, the contact areas between the footprint 66 and the conductors 62, 64 increase due to the shape of the triangular conductor surfaces, thereby increasing the amount of parallel paths and lowering the parallel path resistance component. The contact areas change in size in the device 50 of FIG. 6*a* due to variations in the footprint size, while the contact areas change in size in the device 60 of FIG. 7 due to variations in the shape of the conductor surfaces. As compared to the device 50 of FIG. 6*a*, the variable resistance device 60 depicted in FIG. 7 represents a different way of selecting the geometry, contact locations, and contact areas to produce an alternate embodiment that operates similarly in the parallel path resistance mode.

Another way to ensure that a variable resistance device operates primarily in the parallel path resistance mode is to manipulate the geometric factors and contact variances such that the parallel path resistance component is substantially larger than the straight resistance component. In this way, the change in tile effective resistance is at least substantially equal to the change in the parallel path resistance component.

Figure 8:
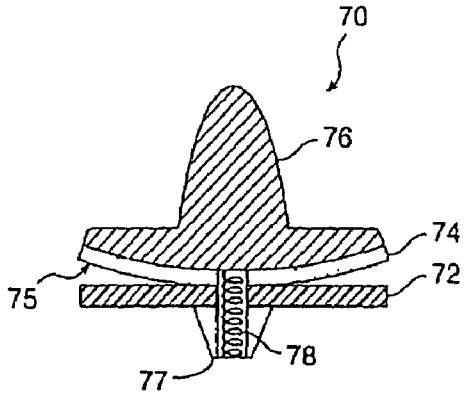
FIG. 8 is a partial cross-sectional view of a variable resistance device exhibiting effective parallel path resistance characteristics in accordance with another embodiment of the invention.

An example of a variable resistance device in which the parallel path resistance component is dominant is a joystick device 70 shown in FIG. 8. The variable resistance joystick device 70 includes a conductive substrate 72, a resistive resilient transducer 74 having a curved resistive surface 75 in rolling contact with the surface of the conductive substrate 72, and a stick 76 coupled with the transducer 74 for moving the transducer 74 relative to the conductive substrate 72. A conductive spring 78 extends through an opening in the central region of the conductive substrate 72 and resiliently couples a center contact portion 79 of the transducer 74 to a fixed pivot region 77 relative to the conductive substrate 72. The spring 78 is electrically insulated from the conductive substrate 72. In the embodiment shown, a voltage is applied through the conductive spring 78 to the center portion of the resistive resilient transducer 74. In a specific embodiment, the resistive resilient transducer 74 has a small thickness which is substantially smaller than the square root of the surface area of the resistive surface 75.

Figure 9A:
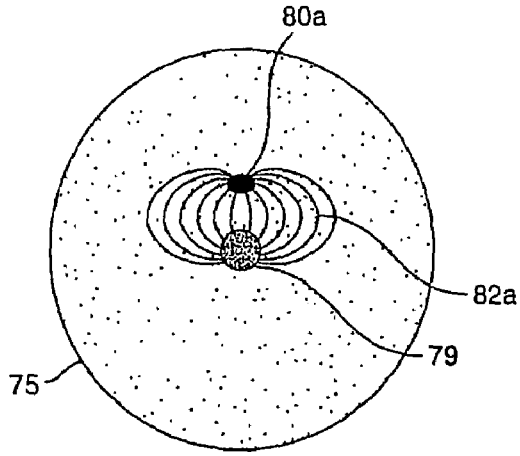
FIGS. 9*a*-9*c* are schematic views illustrating parallel paths for different contact locations in the variable resistance device of FIG. 8.
Figure 9B:
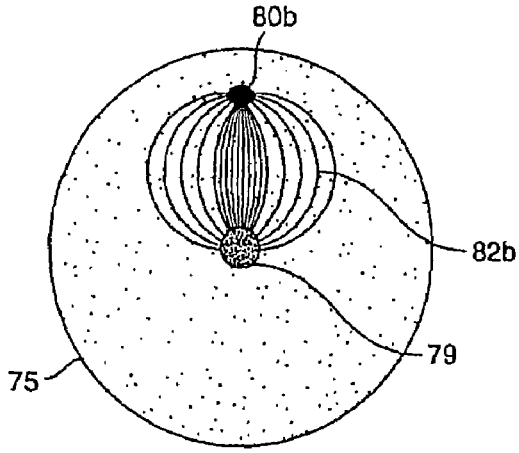
Figure 9C:
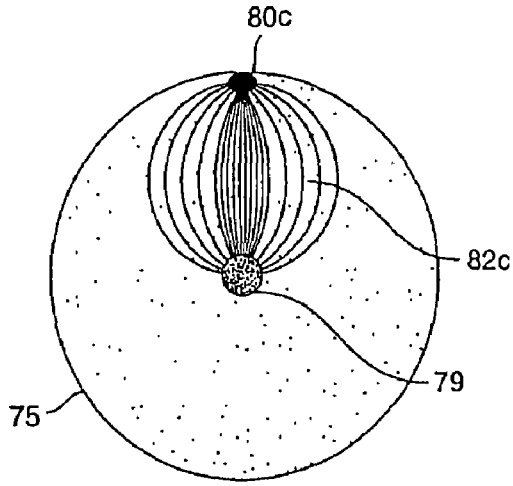

In operation, the user applies a force on the stick 76 to roll the transducer 74 with respect to the conductive substrate 72 while the spring 78 pivots about the pivot region 77. The resistive surface 75 makes movable contact with the surface of the conductive substrate 72. FIGS. 9*a*-9*c* show several movable contact locations or footprints 80*a*, 80*b*, 80*c* on the resistive surface 75 of the transducer 74 at different distances from the contact portion 79 where the voltage is applied. Current flows from the conductive spring 78 to the center contact portion 79 of the transducer 74 through the resistive resilient material of the transducer 74 to the conductive substrate 72 at the contact location (80*a*, 80*b*, 80*c*) where the voltage is read. There will be a drop in voltage from the voltage source at the contact portion 79 to the contact location with the conductive substrate 72 as the current travels through the resistive resilient material of the transducer 74.

FIGS. 9*a*-9*c* schematically illustrate parallel paths 82*a*-82*c* on the resistive surface 75 between the contact portion 79 and the movable contact locations 80*a*-80*c*. FIGS. 9*a*-9*c* do not show the parallel paths through the body of the resistive resilient transducer 74 but only the parallel paths 82*a*-82*c* over the resistive surface 75, which are representative of the amount of parallel paths through the body of the transducer 74 between the contact portion 79 and the movable contact locations 80*a*-80*c*. The contact area sizes of the contact locations 80*a*-80*c* preferably are substantially constant. The shape of the contact area typically is also generally constant.

In FIG. 9*a*, both the contact portion 79 for the applied voltage and the contact location 80*a* are disposed generally in a central region of the resistive surface 75 and away from the outer edge of the resistive surface 75. In this configuration, both the contact portion 79 and the contact location 80*a* are surrounded by resistive resilient material. The current flows from the contact portion 79 in an array of parallel paths 82*a* in many directions into the resistive resilient material of the transducer 74 surrounding the contact portion 79 toward the contact location 80*a* also from different directions surrounding the contact location 80*a*. In contrast, the straight resistance component between the contact portion 79 and the contact location 80*a* as defined by the distance between them is significantly smaller than the dominant parallel path resistance component. Due to the short distance between the contact portion 79 and the contact location 82*a* which limits the amount of resistive resilient material through which the current travels, the amount of parallel paths 82*a* is relatively small.

In FIG. 9*b*, the contact location 80*b* moves further away from the contact portion 79, but still stays generally in a central region of the resistive surface 75 away from the outer edge of the resistive surface 75. Because the contact location 80*b* is spaced further from the contact portion 79, there is a larger amount of resistive resilient material and thus a larger amount of parallel paths 82*b* for the current to flow than in FIG. 9*a*. The increase in parallel paths causes a decrease in the parallel path resistance component. The greater distance between the contact portion 79 and the contact location 80*b* produces an increase in the straight resistance component, but it is still a small component compared to the parallel path component due to the presence of the large amount of parallel paths which more than compensates for the increase in straight resistance. Therefore, the effective resistance decreases as the contact location 80*b* moves further away from the fixed center contact portion 79.

Eventually the additional generation of parallel paths decreases as the distance increases between the contact portion 79 and the contact location increases. In the embodiment shown in FIG. 9*c*, this occurs when the contact location 80*c* approaches the edge of the resistive surface 75, where the contact location 80*c* is no longer surrounded by as much resistive resilient material as in FIGS. 9*a* and 9*b*. The resistive resilient material available for the parallel paths 82*c* is limited by geometric factors. Meanwhile, the straight resistance component continues to increase as a result of the increase in distance.

Figure 10:
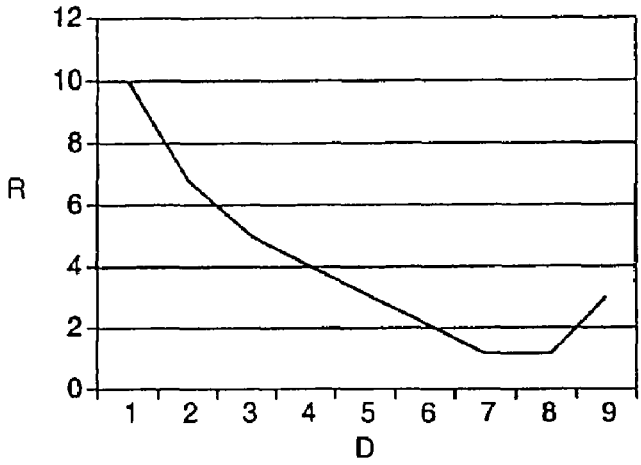
FIG. 10 is a plot of the effective resistance as a function of distance between contact locations for the variable resistance device of FIG. 8.

FIG. 10 shows a plot of the effective resistance R as a function of the footprint distance D from the center contact portion 79. The effective resistance R initially exhibits parallel path resistance characteristics, and decreases as the contact moves from the contact location 80*a* in FIG. 9*a* to contact location 80*b* in FIG. 9*b*. A portion of the resistance curve in FIG. 10 is substantially linear. This occurs where the distance between the center contact portion 79 and the contact location 80*b* is in the medium distance range between about 2.5 and 6.5 normalized with respect to the radius of the resistive surface 75. When the contact location 80*c* approaches the edge of the resistive surface 75 as shown in FIG. 9*c*, a cross-over occurs where the straight resistance component overtakes the parallel path resistance component and becomes the dominant component. This cross-over is seen in FIG. 10 as a rise in the effective resistance with an increase in footprint distance to about 7.5-8.5 near the edge of the resistive surface 75. The cross-over phenomenon can be used in certain applications as a switch activated by the movement of the contact location 82*c* toward the edge of the resistive surface 75.

Figure 11A:
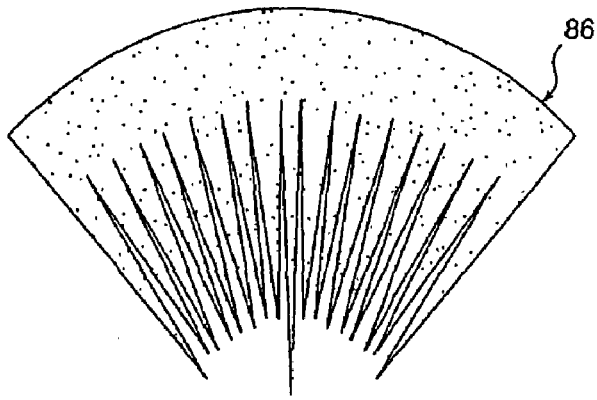
FIG. 11*a* is a schematic view of the a conductive trace pattern of a segment of the substrate in the variable resistance device of FIG. 8 in accordance with another embodiment of the invention.
Figure 11B:
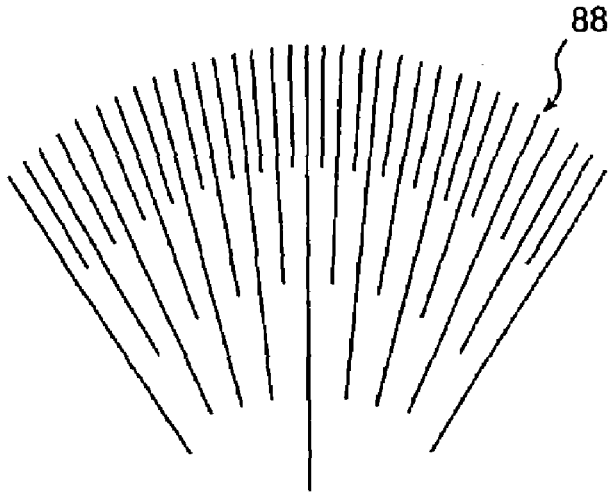
FIG. 11*b* is a schematic view of the another conductive trace pattern of a segment of the substrate in the variable resistance device of FIG. 8 in accordance with another embodiment of the invention.

In FIG. 8, the surface of the conductive substrate 72 over which the resistive resilient transducer 74 rolls and makes movable contact is assumed to be divided into two or more segments (typically four) to provide directional movement in two axes. FIGS. 11*a* and 11*b* show segments of alternative conductive patterns that can be used to modify the resistance characteristics of the variable resistance device 70. FIG. 11*a* shows a continuous conductive pattern 86 on the substrate, while the FIG. 11*b* shows a conductive pattern 88 made up of individual conductive traces. In both cases, the amount of conductive material for contacting with the footprint of the resistive surface 75 increases as the contact location moves further away from the center contact portion 79; Thus, the effective contact area between the resistive footprint and the conductive pattern 86, 88 increases in size as the footprint distance from the center contact portion 79 increases (even though the size of the footprint remains generally constant), so that the increase in the amount of parallel paths is amplified with respect to increase in the footprint distance. As a result, the effective resistance exhibits more pronounced parallel path characteristics until the resistive footprint approaches the edge of the resistive surface 75. The embodiments in FIGS. 11*a* and 11*b* introduce the additional factor of varying the effective contact area to manipulate the effective resistance characteristics of the variable resistance device 70.

As discussed above, the straight path resistance component becomes dominant as the contact location 82*c* of the resistive footprint approaches the edge of the resistive surface 75 as shown in FIGS. 9*c* and 10. Another embodiment of a variable resistance device 90 which makes use of this property is shown in the exploded view of FIG. 12. The device 90 includes a thin sheet of resistive resilient member 92 which is rectangular in the embodiment shown. One corner 94 is energized with an applied voltage V, while another corner 96 is grounded. Alternatively, the second corner 96 can be energized with a different voltage to create a voltage differential across the resistive resilient member 92. A conductive sheet 98 is disposed generally parallel with and spaced above the resistive resilient sheet 92. A force can be applied via a pen 99 or the like to bring the resistive resilient sheet 92 and the conductive sheet 98 in contact at various contact locations. In this variable resistance device 90, the straight resistance component is dominant, partly because the formation of parallel paths is limited by the lack of resistive material surrounding the corners 94, 96. The amount of parallel paths remains limited even when the contact with the conductive sheet 98 is made in the center region of the resistive resilient sheet 92 because the voltage is applied at the corner 94. In contrast, the application of the voltage in the center contact portion 79 in the device 70 shown in FIG. 8 allows current to flow in many directions into the resistive resilient material that surrounds the center contact portion 79.

The above examples illustrate some of the ways of controlling the geometry and contact variances to manipulate the straight resistance and parallel path resistance components to produce an effective resistance having certain desired characteristics.

C. Mechanical Characteristics

Another factor to consider when designing a variable resistance device is the selection of mechanical characteristics for the resistive resilient member and the conductors. This includes, for example, the shapes of the components and their structural disposition that dictates how they interact with each other and make electrical contacts.

Figure 12:
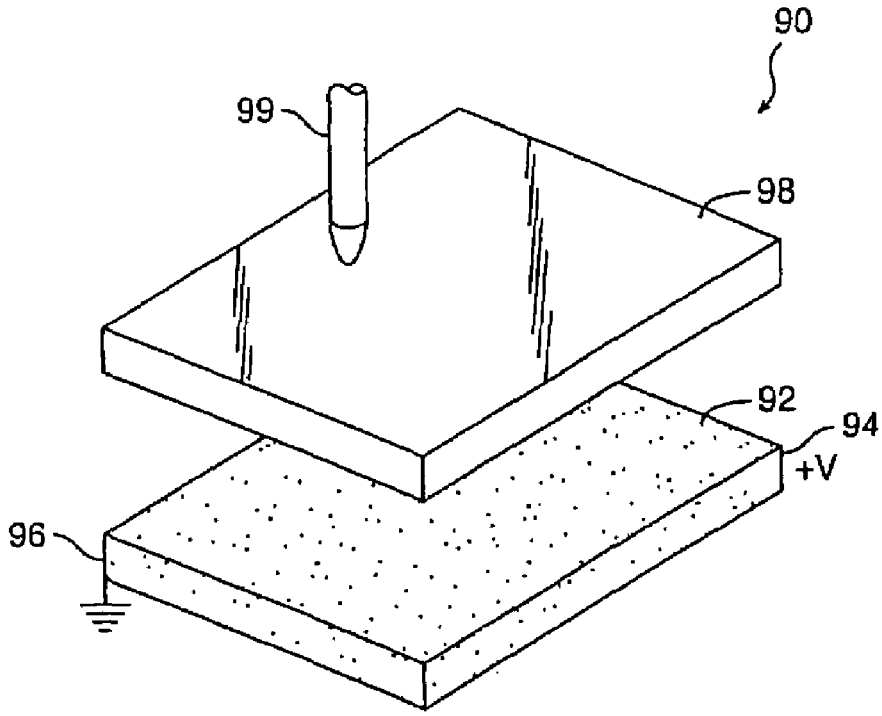
FIG. 12 is an exploded perspective view of a variable resistance device exhibiting effective straight resistance characteristics in accordance with another embodiment of the invention.

The use of a resistive resilient strip 12 to form a potentiometer is illustrated in FIGS. 1-2. The use of conductive bars 32, 34 are shown in FIGS. 5*a* and 5*b*. A flat sheet of resistive resilient material is illustrated in FIG. 12. In the configuration of FIG. 12, typically two corners are energized with voltage potentials and the remaining two corners are grounded. A voltage is read through the contact between the conductive sheet 98 and the resistive resilient sheet 92 and processed to determine the contact location over an X-Y Cartesian coordinate system using methods known in the art. The variable resistance device 90 of this type is applicable, for example, as a mouse pointer or other control interface tools.

Resistive resilient members in the form of curved sheets are shown in FIGS. 5*b* and 8. The examples of FIGS. 5*b* and 8 represent joysticks or joystick-like structures, but the configuration may be used in other applications such as pressure sensors. For instance, the force applied to a curved resistive resilient sheet may be caused by a variable pressure and the contact area between the curved resistive resilient sheet and a conductive substrate may be proportional to the level of the applied pressure. In this way, the change in resistance can be related to the change in pressure so that resistance measurements can be used to compute the applied pressure.

Figure 13:
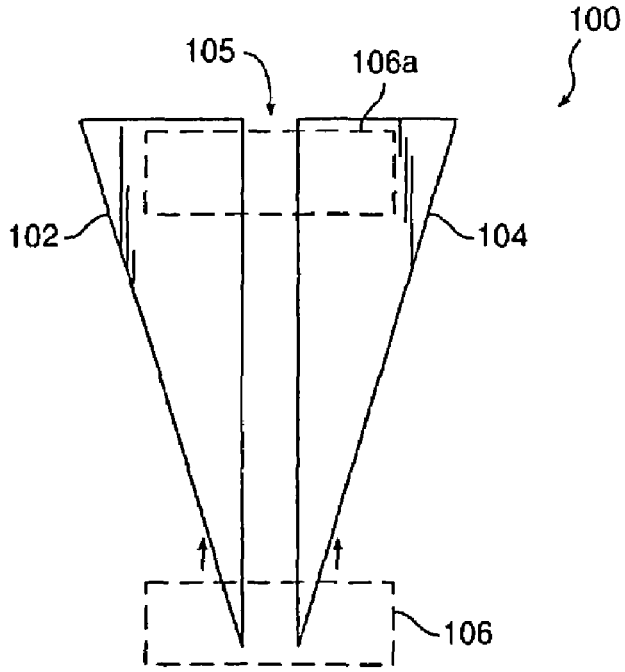
FIG. 13 is a schematic view of a variable resistance device exhibiting effective parallel path resistance characteristics with a rectangular resistive footprint in accordance with another embodiment of the invention.

Another mechanical shape is a rod. In FIG. 4, the example of a conductive rod 26 is shown. A rod produces a generally rectangular footprint. The rod configuration can also be used for a resistive resilient member to produce a rectangular resistive footprint. An example is the variable resistance device 100 shown in FIG. 13, which is similar to the device 60 of FIG. 7. The device 100 has a similar pair of conductors 102, 104 spaced by a similar gap 105. The difference is that the resistive footprints 106, 106*a* are rectangular as opposed to the circular footprints 66, 66*a* in FIG. 7. The change in the shape of the footprint 106 will produce a different resistance response, but the effective resistance is still governed by the parallel path resistance component as in the device 60 of FIG. 7.

Figure 14:
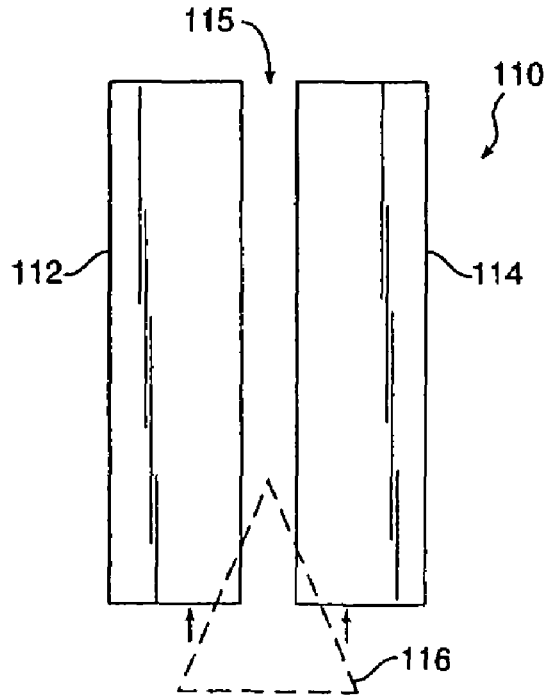
FIG. 14 is a schematic view of a variable resistance device exhibiting effective parallel path resistance characteristics with a triangular resistive footprint in accordance with another embodiment of the invention.

Yet another mechanical shape for a footprint is that of a triangle, which can be produced by a cone or a wedge. In FIG. 14, the variable resistance device 110 is similar to the device 50 in FIG. 6, and includes a pair of conductors 112, 114 spaced by a gap 115. Instead of a circular resistive footprint 56 that changes in size, the device 110 uses a triangular resistive footprint 116 that makes movable contact with the conductors 112, 114 in the direction of the gap 115. As a result, the contact areas between the resistive footprint 116 and the conductors 112, 114 increase in the direction of movement of the footprint 116 even though the footprint 116 is constant in size, creating a similar effect as that illustrated in FIG. 6. In this embodiment, due to the substantial linear increase in contact areas, the resistance response is also substantially linear.

Figure 15:
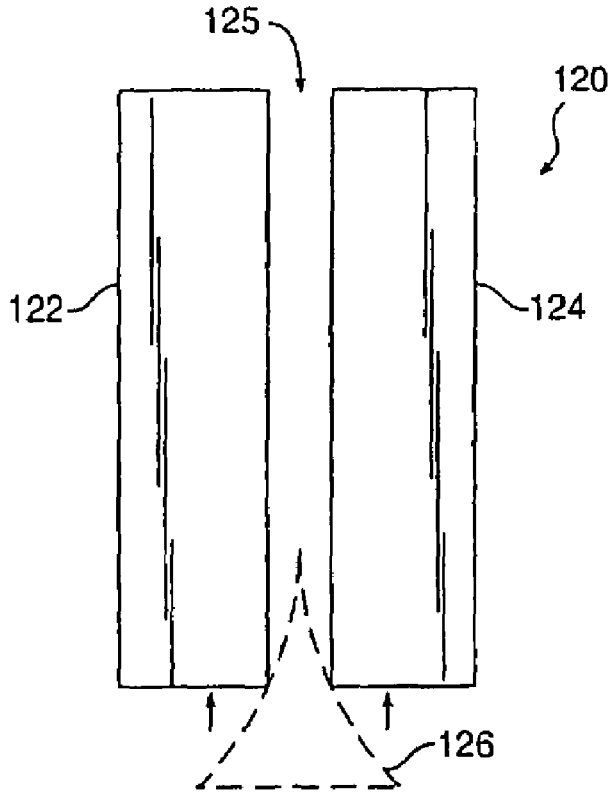
FIG. 15 is a schematic view of a variable resistance device exhibiting effective parallel path resistance characteristics with a logarithmic resistive footprint in accordance with another embodiment of the invention.
Figure 16:
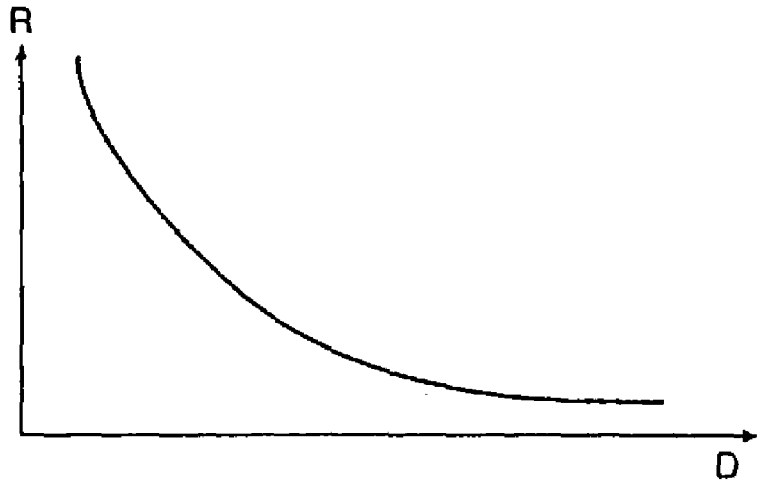
FIG. 16 is a plot of the effective resistance as a function of displacement of the resistive footprint for the variable resistance device of FIG. 15.

In the variable resistance device 120 of FIG. 15, the shape of the triangular resistive footprint 126 is modified to produce a logarithmic resistance response when it makes movable contact with the conductors 122, 124 in the direction of the gap 125. The change in resistance R is proportional to the logarithm of the displacement D of the resistive footprint 126 in the direction of the gap 125. A plot of the change in resistance R versus the displacement D of the resistive footprint 126 is shown in FIG. 16.

Figure 17:
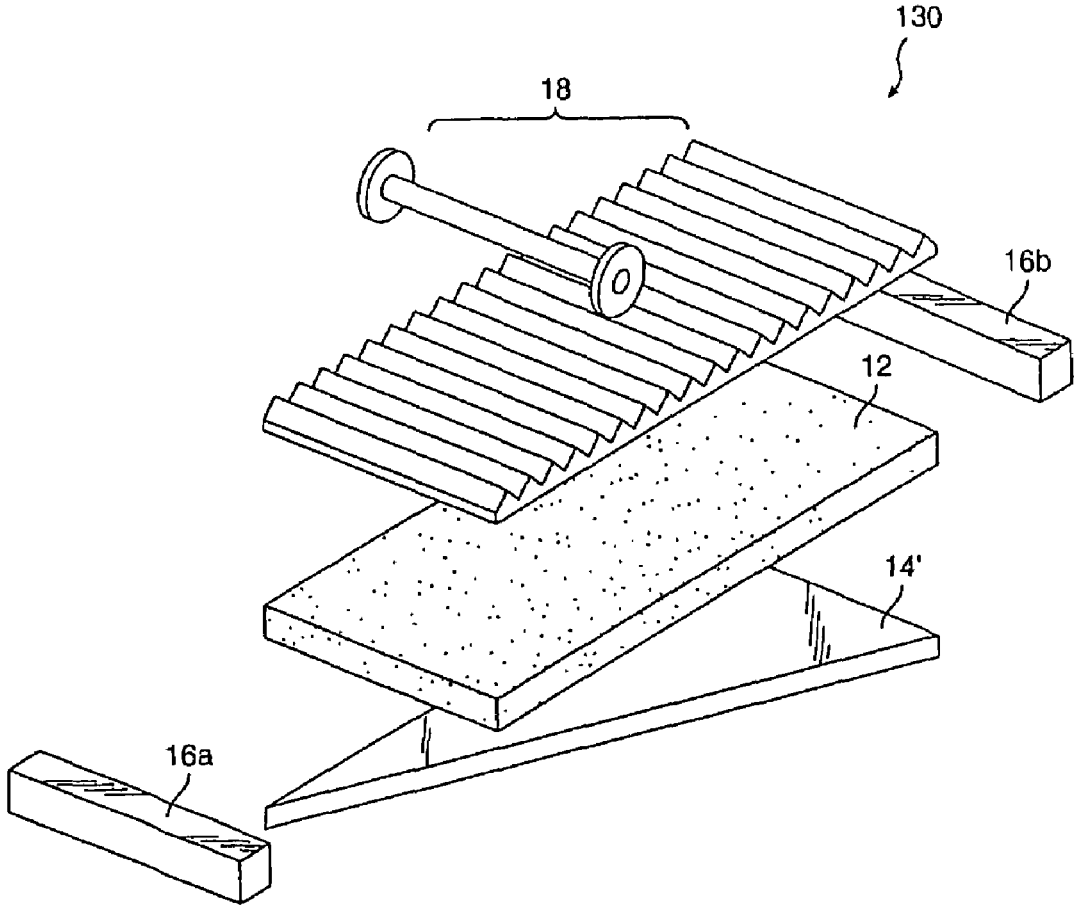
FIG. 17 is an exploded perspective view of a variable resistance device exhibiting effective straight resistance characteristics with a logarithmic conductor footprint in accordance with another embodiment of the invention.
Figure 18:
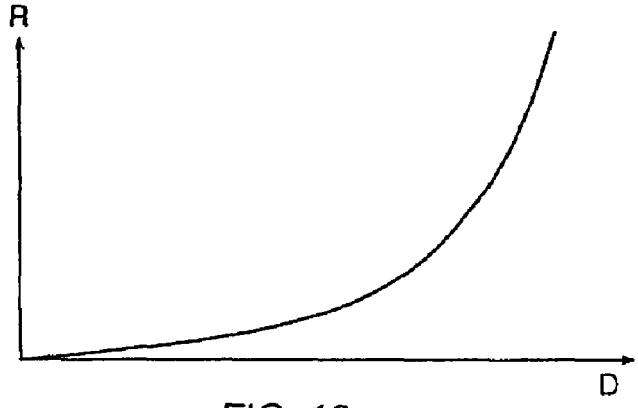
FIG. 18 is a plot of the effective resistance as a function of contact location between the resistive resilient transducer and the conductor footprint for the variable resistance device of FIG. 17.

A logarithmic resistance response can also be produced using the embodiment of FIGS. 1-2 if the rectangular conductive member 14 is replaced by a generally triangular conductive member 14', as illustrated in the variable resistance device 130 of FIG. 17. The conductor 16*a* is grounded while the conductor 16*b* is energized with a voltage V. FIG. 18 shows a plot of the resistance R versus the distance of the contact location between the resistive resilient transducer 12 and the conductive member 14' measured from the end of the transducer 12 adjacent the conductor 16*b* where the voltage V is applied.

As illustrated by the above examples, resistive resilient materials can be shaped and deformed in ways that facilitate the design of variable resistance devices having a variety of different geometries and applications. Furthermore, devices made of resistive resilient materials are often more reliable. For instance, the potentiometer 10 shown in FIGS. 1-2 provides a resistive resilient transducer 12 having a relatively large contact area as compared to those in conventional devices. The problem of wear is lessened. The large contact area also renders the potentiometer 10 less sensitive than conventional devices to contamination such as the presence of dust particles.

It will be understood that the above-described arrangements of apparatus and methods therefrom are merely illustrative of applications of the principles of this invention and many other embodiments and modifications may be made without departing from the spirit and scope of the invention as defined in the claims. For instance, alternate shapes and structural connections can be utilized to produce variable resistance devices having a variety of different resistance characteristics. Geometric factors and contact variances can be manipulated in other ways to produce specific resistance responses.

What is claimed is:

1. A variable resistor apparatus comprising:

first and second conductors lying in a plane and defining a gap therebetween; and a resistive member comprising a resistive resilient material for bridging the gap and defining a variable resistance between the first and second conductors based upon a variable contact footprint, the variable contact footprint being substantially circular in shape at at least one position.

2. The variable resistor apparatus of claim 1 wherein the contact footprint varies substantially symmetrically in the plane of the first and second conductors.

3. The variable resistor apparatus of claim 1 wherein the gap has a width that is substantially constant.

4. The variable resistor apparatus of claim 1 wherein the variable resistance varies substantially linearly with a proportional change in a size of the contact footprint.

5. The variable resistor apparatus of claim 1 wherein the contact footprint is reversibly formable from the substantially circular shape to a substantially elliptical shape.

6. The variable resistor apparatus of claim 1 wherein the resistive member has substantially uniform resistance per unit area over the contact footprint.

7. The variable resistor apparatus of claim 1 wherein the resistive member is configured to change the contact footprint in response to a force substantially perpendicular to the contact footprint.

8. The variable resistor apparatus of claim 7 further comprising a joystick coupled to the resistive member for applying the force.

9. The variable resistor apparatus of claim 1 wherein the gap has a serrated shape.

10. A variable resistor apparatus comprising:

first and second conductors lying in a plane defining a serrated gap therebetween; and a resistive member comprising a resistive resilient material for bridging the serrated gap and defining a variable resistance between the first and second conductors based upon a variable contact footprint.

11. The variable resistor apparatus of claim 10 wherein the contact footprint varies substantially symmetrically in the plane of the first and second conductors.

12. The variable resistor apparatus of claim 10 wherein the variable resistance varies non-linearly with a proportional change in a size of the contact footprint.

13. The variable resistor apparatus of claim 10 wherein the contact footprint is reversibly formable from a substantially circular shape to a substantially elliptical shape.

14. The variable resistor apparatus of claim 10 wherein the resistive member has substantially uniform resistance per unit area over the contact footprint.

15. The variable resistor apparatus of claim 10 wherein the resistive member is configured to change the contact footprint in response to a force substantially perpendicular to the contact footprint.

16. The variable resistor apparatus of claim 15 further comprising a joystick coupled to the resistive member for applying the force.

* * * * *